US011414615B2

(12) United States Patent
Mochida et al.

(10) Patent No.: US 11,414,615 B2
(45) Date of Patent: Aug. 16, 2022

(54) POWER TRANSMISSION LUBRICANT OIL BASE OIL

(71) Applicant: NEW JAPAN CHEMICAL CO., LTD., Kyoto (JP)

(72) Inventors: Hirotsugu Mochida, Kyoto (JP); Akinobu Takegami, Kyoto (JP); Shunsuke Ano, Kyoto (JP)

(73) Assignee: NEW JAPAN CHEMICAL CO., LTD., Kyoto (JP)

( * ) Notice: Subject to any disclaimer, the term of this patent is extended or adjusted under 35 U.S.C. 154(b) by 0 days.

(21) Appl. No.: 17/283,169

(22) PCT Filed: Oct. 11, 2019

(86) PCT No.: PCT/JP2019/040143
§ 371 (c)(1),
(2) Date: Apr. 6, 2021

(87) PCT Pub. No.: WO2020/080269
PCT Pub. Date: Apr. 23, 2020

(65) Prior Publication Data

US 2021/0340456 A1 Nov. 4, 2021

(30) Foreign Application Priority Data

Oct. 19, 2018 (JP) ..... JP2018-197159

(51) Int. Cl.
*C10M 105/38* (2006.01)
*C10N 40/04* (2006.01)

(52) U.S. Cl.
CPC .. *C10M 105/38* (2013.01); *C10M 2207/2835* (2013.01); *C10N 2040/046* (2020.05)

(58) Field of Classification Search
CPC ..... C10M 105/38; C10M 105/32; C10M 2207/2805; C10M 2207/281; C10M 2207/2815
USPC ..... 508/484
See application file for complete search history.

(56) References Cited

U.S. PATENT DOCUMENTS 4,886,613 A * 12/1989 Yoshimura ..... C10M 105/36 252/79
4,886,614 A 12/1989 Yoshimura et al.
4,889,650 A * 12/1989 Yoshimura ..... C10M 105/32 252/79
5,039,440 A 8/1991 Yoshimura et al.
5,075,024 A * 12/1991 Yoshimura ..... C10M 105/34 252/79
5,085,792 A * 2/1992 Narihiko ..... C10M 143/04 252/79
5,126,065 A 6/1992 Tsubouchi et al.
5,259,978 A * 11/1993 Yoshimura ..... C10M 171/002 252/79
6,242,393 B1 * 6/2001 Ishida ..... C10M 105/00 252/73
6,638,417 B2 * 10/2003 Ishida ..... C10M 105/20 208/19
2005/0038283 A1 2/2005 Kawahara et al.
2010/0130394 A1 5/2010 Tsubouchi

FOREIGN PATENT DOCUMENTS

EP 0 328 641 A1 8/1989
EP 0 344 307 A1 12/1989
JP 47-7664 A 4/1972
JP 59-191797 A 10/1984
JP 62-153393 A 7/1987
JP 62-153395 A 7/1987
JP 63-245491 A 10/1988
JP 3-95295 A 4/1991
JP 2010-265466 A 11/2010
JP 2013-76098 A 4/2013
(Continued)

OTHER PUBLICATIONS

International Search Report dated Nov. 26, 2019, issued in counterpart International Application No. PCT/JP2019/040143, with English Translation. (4 pages).

*Primary Examiner* — Ellen M McAvoy
(74) *Attorney, Agent, or Firm* — WHDA, LLP

(57) ABSTRACT

An object of the present invention is to provide a lubricant base oil for power transmission that has a high traction coefficient and a high flash point, and excellent low-temperature fluidity. The present invention relates to a lubricant base oil for power transmission containing a compound represented by formula (1):

(1)

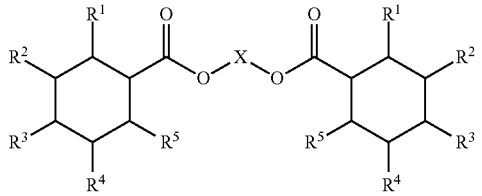

wherein $R^1$ to $R^5$ are the same or different, and each represents a hydrogen atom or a $C_{1-4}$ linear or branched alkyl group, any two of $R^1$ to $R^5$ may bind to each other to form a $C_{1-4}$ alkylene group, two $R^1$s, two $R^2$s, two $R^3$s, two $R^4$s, and two $R^5$s may be individually the same or different, X is obtained by removing two hydroxyl groups from a $C_{4-12}$ branched aliphatic diol and represents a divalent group containing no quaternary carbon, and the two hydroxyl groups are each of a primary alcohol.

5 Claims, No Drawings

(56) References Cited

FOREIGN PATENT DOCUMENTS

| | | | |
|---|---|---|---|
| JP | 2016-108543 | A | 6/2016 |
| JP | 2018-2955 | A | 1/2018 |
| JP | 2018-35203 | A | 3/2018 |
| WO | 88/10292 | A1 | 12/1988 |
| WO | 89/01020 | A1 | 2/1989 |

* cited by examiner

POWER TRANSMISSION LUBRICANT OIL BASE OIL

TECHNICAL FIELD

The present invention relates to a lubricant base oil for power transmission. Specifically, the present invention relates to lubricant base oil for traction drives.

BACKGROUND ART

The advance of the digital information society has increased the demand for precision in printers and photocopiers. In particular, motor parts that must feed paper highly precisely are required to exhibit high rotation accuracy, low vibration, and low noise levels. Because a gear system used as a power transmission means of these rotary parts causes vibration and noise in high levels, traction drives, which cause less vibration and noise, are often used.

Industrial robots have also become widespread, and traction drives are also used in their joint parts, which are required to perform precise movement. Additionally, traction drives have also become increasingly commercially viable in the areas of, for example, continuously variable transmissions for industrial machines, aircraft generators, and rotor speed control of helicopters. In order to increase the amount of power transmission, there have been attempts to increase the size of traction drives; however, more heat tends to be generated as the contact area increases.

Lubricant base oils for traction drives that have a high traction coefficient are preferable for higher power transmission performance; for example, alicyclic hydrocarbon compounds have been suggested. Examples of alicyclic hydrocarbon compounds include dicyclohexyl compounds such as 2-methyl-2,4-dicyclohexylpentane and dimerized norbornanes (PTL 1 and 2).

However, due to their tendency to have a low flash point of 200° C. or below, alicyclic hydrocarbon compounds such as 2-methyl-2,4-dicyclohexylpentane are not necessarily satisfactory in areas in which large traction drives are used, and emphasis is on heat resistance and safety.

The Examples of PTL 3 disclose diester compounds synthesized from neopentyl glycol and cyclohexanecarboxylic acid, neopentyl glycol and methylcyclohexanecarboxylic acid, and neopentyl glycol, cyclohexanecarboxylic acid, and methylcyclohexanecarboxylic acid as traction fluid. The Examples of PTL 4 also disclose diester compounds synthesized from cyclohexanol and malonic acid, ethylene glycol and cyclohexanecarboxylic acid, and 1,3-butanediol and cyclohexanecarboxylic acid as traction fluid.

CITATION LIST

Patent Literature

PTL 1: JPS47-7664A
PTL 2: JPH03-95295A
PTL 3: WO88/10292A
PTL 4: WO89/01020A

SUMMARY OF INVENTION

Technical Problem

An object of the present invention is to provide a lubricant base oil for power transmission that has a high traction coefficient and a high flash point, and excellent low-temperature fluidity (in particular, a lubricant base oil for traction drives).

Solution to Problem

The present inventors found that specific compounds have a high traction coefficient and a high flash point, and excellent low-temperature fluidity. The inventors conducted further research based on this finding and completed the present invention.

Specifically, the present invention provides the following lubricant base oils for power transmission (in particular, lubricant base oils for traction drives).

Item 1.

A lubricant base oil for power transmission, the lubricant base oil comprising a compound represented by formula (1)

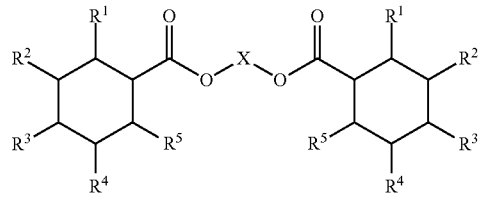

(1)

wherein $R^1$ to $R^5$ are the same or different, and each represents a hydrogen atom or a $C_{1-4}$ linear or branched alkyl group, any two of $R^1$ to $R^5$ may bind to each other to form a $C_{1-4}$ alkylene group, two $R^1$s, two $R^2$s, two $R^3$s, two $R^4$s, and two $R^5$s may be individually the same or different, X is obtained by removing two hydroxyl groups from a $C_{4-12}$ branched aliphatic diol and represents a divalent group containing no quaternary carbon, and the two hydroxyl groups are each of a primary alcohol.

Item 2.

The lubricant base oil for power transmission according to item 1, wherein $R^1$ to $R^5$ in formula (1) are the same or different, and each represents a hydrogen atom, a methyl group, an ethyl group, an isopropyl group, or a tert-butyl group, and any two of $R^1$ to $R^5$ may bind to each other to form a methylene group or a butylene group.

Item 3.

The lubricant base oil for power transmission according to item 1 or 2, wherein X in formula (1) is a divalent group that includes a linear alkylene group having three or more carbon atoms as a main chain, and that has at least one group bound to a carbon atom on the main chain, the at least one group being selected from the group consisting of a methyl group and an ethyl group.

Item 4.

The lubricant base oil for power transmission according to any one of Items 1 to 3, wherein X in formula (1) is a divalent group obtained by removing two hydroxyl groups from one member selected from the group consisting of 2-methyl-1,3-propanediol, 3-methyl-1,5-pentanediol, and 2,4-diethyl-1,5-pentanediol.

Item 5.

The lubricant base oil for power transmission according to any one of Items 1 to 4, wherein the content of the compound represented by formula (1) in the lubricant base oil for power transmission is 70 mass % or more.

Item 6.

The lubricant base oil for power transmission according to any one of Items 1 to 5, wherein the lubricant base oil for power transmission is a lubricant base oil for traction drives.

Item 7.

A lubricant oil for power transmission comprising the lubricant base oil for power transmission of any one of Items 1 to 6.

Advantageous Effects of Invention

By containing a compound represented by formula (1), the lubricant base oil for power transmission according to the present invention (in particular, a lubricant base oil for traction drives) has a high traction coefficient and a high flash point, and excellent low-temperature fluidity.

DESCRIPTION OF EMBODIMENTS

A feature of the lubricant base oil for power transmission according to the present invention is that the lubricant base oil contains a compound represented by formula (1):

(1)

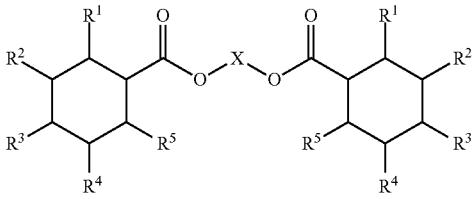

wherein $R^1$ to $R^5$ are the same or different, and each represents a hydrogen atom or a $C_{1-4}$ linear or branched alkyl group, any two of $R^1$ to $R^5$ may bind to each other to form a $C_{1-4}$ alkylene group, two $R^1$s, two $R^2$s, two $R^3$s, two $R^4$s, and two $R^5$s may be individually the same or different, X is obtained by removing two hydroxyl groups from a $C_{4-12}$ branched aliphatic diol and represents a divalent group containing no quaternary carbon, and the two hydroxyl groups are each of a primary alcohol.

The compound represented by formula (1) in the present invention can also be expressed as a compound represented by formula (1'):

(1')

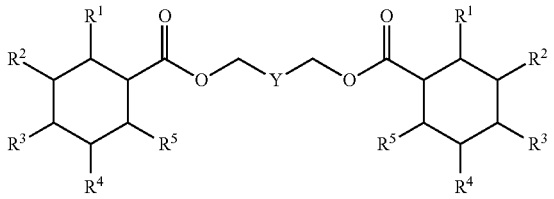

wherein $R^1$ to $R^5$ are synonymous with $R^1$ to $R^5$ in formula (1), and Y represents a $C_{2-10}$ branched alkylene group containing no quaternary carbon. Specifically, "X" in formula (1) can be expressed as $CH_2$—Y—$CH_2$.

The "$C_{1-4}$ linear or branched alkyl group" indicated by $R^1$ to $R^5$ in formula (1) may be a methyl group, an ethyl group, a n-propyl group, an isopropyl group, a n-butyl group, an isobutyl group, a sec-butyl group, a tert-butyl group, or the like. The "$C_{1-4}$ linear or branched alkyl group" is preferably a methyl group, an ethyl group, an isopropyl group, or a tert-butyl group, and more preferably a methyl group, an ethyl group, or a tert-butyl group. Preferably, at least two of $R^1$ to $R^5$ are hydrogen atoms, and more preferably at least three of $R^1$ to $R^5$ are hydrogen atoms.

The number of $C_{1-4}$ alkylene groups formed by any two of $R^1$ to $R^5$ binding to each other in formula (1) is preferably one per cyclohexyl ring. The alkylene group may be a methylene group, an ethylene group, a propylene group, a butylene group, a methyl methylene group, a dimethyl methylene group, a methyl ethylene group, or the like. The alkylene group is preferably a methylene group, an ethylene group, or a butylene group, and more preferably a methylene group. The alkylene group is preferably a group formed by a bond of $R^1$ and $R^4$, a group formed by a bond of $R^1$ and $R^2$, or a group formed by a bond of $R^2$ and $R^3$, and more preferably a group formed by a bond of $R^1$ and $R^4$.

In formula (1), two $R^1$s, two $R^2$s, two $R^3$s, two $R^4$s, and two $R^5$s may be individually the same or different, and are preferably the same.

In formula (1), $R^1$ to $R^5$ according to an embodiment may be the same or different, and individually a hydrogen atom, a methyl group, an ethyl group, an isopropyl group, or a tert-butyl group. Any two of $R^1$ to $R^5$ (preferably $R^1$ and $R^4$, $R^1$ and $R^2$, or $R^2$ and $R^3$) may bind to each other to form a $C_{1-4}$ alkylene group. Two $R^1$s, two $R^2$s, two $R^3$s, two $R^4$s, and two $R^5$s are more preferably individually the same.

In formula (1), $R^1$ to $R^5$ according to an embodiment may be the same or different, and individually a hydrogen atom, a methyl group, an ethyl group, or a tert-butyl group. Any two of $R^1$ to $R^5$ (preferably $R^1$ and $R^4$, $R^1$ and $R^2$, or $R^2$ and $R^3$) may bind to each other to form a methylene group, an ethylene group, a propylene group, a methyl methylene group, a dimethyl methylene group, a methyl ethylene group, or a butylene group. Two $R^1$s, two $R^2$s, two $R^3$s, two $R^4$s, and two $R^5$s are more preferably individually the same.

In formula (1), X is obtained by removing two hydroxyl groups from a $C_{4-12}$ branched aliphatic diol and represents a divalent group containing no quaternary carbon, and the two hydroxyl groups are each of a primary alcohol. X can also be referred to as a "residue obtained by removing the hydroxyl groups from a $C_{4-12}$ branched aliphatic diol." In the present specification and the claims, X may be simply referred to as "branched aliphatic diol residue." The number of carbon atoms of X refers to the total number of carbon atoms that constitute a "branched aliphatic diol residue."

In X, a linear alkylene group having two methylene groups each bound to an oxygen atom at an end may be referred to as a "main chain." An alkyl group bound to the main chain is also referred to as a "side chain." The number of carbon atoms that constitute the main chain is preferably higher than the number of carbon atoms that constitute the side chain, but can be lower.

In formula (1), the number of carbon atoms of X is preferably 4 to 9, and more preferably 4, 6, or 9. The number of carbon atoms of the main chain that constitutes X is 3 or more, preferably 3 to 9, more preferably 3 to 7, and still more preferably 3 to 5. The number of carbon atoms of each side chain that constitutes X is 1 or more, preferably 1 to 3, and more preferably 1 or 2.

The number of side chains that constitute X is 1 or more, preferably 1 to 3, more preferably 1 or 2, and still more preferably 1. The side chain is preferably a methyl group, an ethyl group, a propyl group, or an isopropyl group, and more preferably a methyl group or an ethyl group. If there are multiple side chains, the multiple side chains may be the same or different.

X can be expressed as "$CH_2$—Y—$CH_2$" wherein Y represents a $C_{2-10}$ branched alkylene group containing no quaternary carbon. Preferable examples of Y and the details of Y would be able to be understood by a person skilled in the art from the description of Y in the present specification and the claims.

Specific examples of X include a 2-methyl-1,3-propanediol residue, a 2-ethyl-1,3-propanediol residue, a 2-methyl-1,4-butanediol residue, a 2-ethyl-1,4-butanediol residue, a 2,3-dimethyl-1,4-butanediol residue, a 2,3-diethyl-1,4-butanediol residue, a 2-ethyl-3-methyl-1,4-butanediol residue, a 2-methyl-1,5-pentanediol residue, a 3-methyl-1,5-pentanediol residue, a 2-ethyl-1,5-pentanediol residue, a 3-ethyl-1,5-pentanediol residue, a 2,3-dimethyl-1,5-pentanediol residue, a 2,4-dimethyl-1,5-pentanediol residue, a 2,3-diethyl-1,5-pentanediol residue, a 2,4-diethyl-1,5-pentanediol residue, a 2-ethyl-3-methyl-1,5-pentanediol residue, a 2-ethyl-4-methyl-1,5-pentanediol residue, a 3-ethyl-2-methyl-1,5-pentanediol residue, a 2,3,4-trimethyl-1,5-pentanediol residue, a 2,3,4-triethyl-1,5-pentanediol residue, a 2-ethyl-3,4-dimethyl-1,5-pentanediol residue, a 3-ethyl-2,4-dimethyl-1,5-pentanediol residue, a 2,3-diethyl-4-methyl-1,5-pentanediol residue, a 2,4-diethyl-3-methyl-1,5-pentanediol residue, a 2-methyl-1,6-hexanediol residue, a 3-methyl-1,6-hexanediol residue, a 2-ethyl-1,6-hexanediol residue, a 3-ethyl-1,6-hexanediol residue, a 2-methyl-1,7-heptanediol residue, a 3-methyl-1,7-heptanediol residue, a 4-methyl-1,7-heptanediol residue, a 2-ethyl-1,7-heptanediol residue, a 3-ethyl-1,7-heptanediol residue, a 4-ethyl-1,7-heptanediol residue, a 2-methyl-1,8-octanediol residue, a 3-methyl-1,8-octanediol residue, a 4-methyl-1,8-octanediol residue, a 2-ethyl-1,8-octanediol residue, a 3-ethyl-1,8-octanediol residue, a 4-ethyl-1,8-octanediol residue, a 2-methyl-1,9-nonanediol residue, a 3-methyl-1,9-nonanediol residue, a 4-methyl-1,9-nonanediol residue, a 5-methyl-1,9-nonanediol residue, a 2-ethyl-1,9-nonanediol residue, a 3-ethyl-1,9-nonanediol residue, a 4-ethyl-1,9-nonanediol residue, a 5-ethyl-1,9-nonanediol residue, a 2-methyl-1,10-decanediol residue, a 3-methyl-1,10-decanediol residue, a 4-methyl-1,10-decanediol residue, a 5-methyl-1,10-decanediol residue, a 2-ethyl-1,10-decanediol residue, a 3-ethyl-1,10-decanediol residue, a 4-ethyl-1,10-decanediol residue, and a 5-ethyl-1,10-decanediol residue. Of these, a 2-methyl-1,3-propanediol residue, a 2-ethyl-1,3-propanediol residue, a 3-methyl-1,5-pentanediol residue, a 3-ethyl-1,5-pentanediol residue, a 2,4-dimethyl-1,5-pentanediol residue, a 2,4-diethyl-1,5-pentanediol residue, a 2-methyl-1,7-heptanediol residue, a 3-methyl-1,7-heptanediol residue, a 2-ethyl-1,7-heptanediol residue, and a 3-ethyl-1,7-heptanediol residue are preferable; a 2-methyl-1,3-propanediol residue, a 3-methyl-1,5-pentanediol residue, and a 2,4-diethyl-1,5-pentanediol residue are more preferable.

In a preferable embodiment, the compound represented by formula (1) is a compound represented by formula (1) wherein $R^1$ to $R^5$ are the same or different, and each represents a hydrogen atom, a methyl group, an ethyl group, a n-propyl group, an isopropyl group, or a tert-butyl group (preferably a hydrogen atom, a methyl group, an ethyl group, or a tert-butyl group); at least two of $R^1$ to $R^5$ (preferably at least three) are hydrogen atoms; any two of $R^1$ to $R^5$ (preferably $R^1$ and $R^4$) may bind to each other to form a methylene group, an ethylene group, a methyl methylene group, a dimethyl methylene group, a methyl ethylene group, or a butylene group; the number of the alkylene groups is one per cyclohexyl ring; two $R^1$s, two $R^2$s, two $R^3$s, two $R^4$s, and two $R^5$s may be individually the same or different; and X represents a 2-methyl-1,3-propanediol residue, a 2-ethyl-1,3-propanediol residue, a 3-methyl-1,5-pentanediol residue, a 3-ethyl-1,5-pentanediol residue, a 2,4-dimethyl-1,5-pentanediol residue, a 2,4-diethyl-1,5-pentanediol residue, a 2-methyl-1,7-heptanediol residue, a 3-methyl-1,7-heptanediol residue, a 2-ethyl-1,7-heptanediol residue, or a 3-ethyl-1,7-heptanediol residue (preferably, a 2-methyl-1,3-propanediol residue, a 3-methyl-1,5-pentanediol residue, or a 2,4-diethyl-1,5-pentanediol residue).

Specific examples of the compound represented by formula (1) include 2-methyl-1,3-propanediol di(cyclohexanecarboxylate), 2-methyl-1,3-propanediol bis(2-methylcyclohexanecarboxylate), 2-methyl-1,3-propanediol bis(3-methylcyclohexanecarboxylate), 2-methyl-1,3-propanediol bis(4-methylcyclohexanecarboxylate), 2-methyl-1,3-propanediol bis(2,3-dimethylcyclohexanecarboxylate), 2-methyl-1,3-propanediol bis(2,4-dimethylcyclohexanecarboxylate), 2-methyl-1,3-propanediol bis(2,5-dimethylcyclohexanecarboxylate), 2-methyl-1,3-propanediol bis(2,6-dimethylcyclohexanecarboxylate), 2-methyl-1,3-propanediol bis(3,4-dimethylcyclohexanecarboxylate), 2-methyl-1,3-propanediol bis(3,5-dimethylcyclohexanecarboxylate), 2-methyl-1,3-propanediol bis(2-tert-butylcyclohexanecarboxylate), 2-methyl-1,3-propanediol bis(3-tert-butylcyclohexanecarboxylate), 2-methyl-1,3-propanediol bis(4-tert-butylcyclohexanecarboxylate), 2-methyl-1,3-propanediol bis(bicyclo[2.2.1]heptylcarboxylate), 2-methylpropane-1,3-diyl bis(decahydronaphthalene-1-carboxylate), 2-methylpropane-1,3-diyl bis(decahydronaphthalene-2-carboxylate), 3-methyl-1,5-pentanediol di(cyclohexanecarboxylate), 3-methyl-1,5-pentanediol bis(2-methylcyclohexanecarboxylate), 3-methyl-1,5-pentanediol bis(3-methylcyclohexanecarboxylate), 3-methyl-1,5-pentanediol bis(4-methylcyclohexanecarboxylate), 3-methyl-1,5-pentanediol bis(2,3-dimethylcyclohexanecarboxylate), 3-methyl-1,5-pentanediol bis(2,4-dimethylcyclohexanecarboxylate), 3-methyl-1,5-pentanediol bis(2,5-dimethylcyclohexanecarboxylate), 3-methyl-1,5-pentanediol bis(2,6-dimethylcyclohexanecarboxylate), 3-methyl-1,5-pentanediol bis(3,4-dimethylcyclohexanecarboxylate), 3-methyl-1,5-pentanediol bis(3,5-dimethylcyclohexanecarboxylate), 3-methyl-1,5-pentanediol bis(2-tert-butylcyclohexanecarboxylate), 3-methyl-1,5-pentanediol bis(3-tert-butylcyclohexanecarboxylate), 3-methyl-1,5-pentanediol bis(4-tert-butylcyclohexanecarboxylate), 3-methyl-1,5-pentanediol bis(bicyclo[2.2.1]heptylcarboxylate), 3-methylpentane-1,5-diyl bis(decahydronaphthalene-1-carboxylate), 3-methylpentane-1,5-diyl bis(decahydronaphthalene-2-carboxylate), 2,4-diethyl-1,5-pentanediol di(cyclohexanecarboxylate), 2,4-diethyl-1,5-pentanediol bis(2-methylcyclohexanecarboxylate), 2,4-diethyl-1,5-pentanediol bis(3-methylcyclohexanecarboxylate), 2,4-diethyl-1,5-pentanediol bis(4-methylcyclohexanecarboxylate), 2,4-diethyl-1,5-pentanediol bis(2,3-dimethylcyclohexanecarboxylate), 2,4-diethyl-1,5-pentanediol bis(2,4-dimethylcyclohexanecarboxylate), 2,4-diethyl-1,5-pentanediol bis(2,5-dimethylcyclohexanecarboxylate), 2,4-diethyl-1,5-pentanediol bis(2,6-dimethylcyclohexanecarboxylate), 2,4-diethyl-1,5-pentanediol bis(3,4-dimethylcyclohexanecarboxylate), 2,4-diethyl-1,5-pentanediol bis(3,5-dimethylcyclohexanecarboxylate), 2,4-diethyl-1,5-pentanediol bis(2-tert-butylcyclohexanecarboxylate), 2,4-diethyl-1,5-pentanediol bis(3-tert-butylcyclohexanecarboxylate), 2,4-diethyl-1,5-pentanediol bis(4-tert-butylcyclohexanecarboxylate), 2,4-diethyl-1,5-pentanediol bis(bicyclo[2.2.1]heptylcarboxylate), 2,4-diethylpentane-1,5-diyl bis(decahydronaphthalene-1-carboxylate), and 2,4-diethylpentane-1,5-diyl bis(decahydronaphthalene-2-carboxylate).

Of these, 2-methyl-1,3-propanediol di(cyclohexanecarboxylate), 2-methyl-1,3-propanediol bis(2-methylcyclohexanecarboxylate), 2-methyl-1,3-propanediol bis(3-methylcyclohexanecarboxylate), 2-methyl-1,3-propanediol bis(4-methylcyclohexanecarboxylate), 3-methyl-1,5-pentanediol di(cyclohexanecarboxylate), 3-methyl-1,5-pentanediol bis(2-methylcyclohexanecarboxylate), 3-methyl-1,5-pentanediol bis(3-methylcyclohexanecarboxylate), 3-methyl-1,5-pentanediol bis(4-methylcyclohexanecarboxylate), 3-methyl-1,5-pentanediol bis(3,4-dimethylcyclohexanecarboxylate), 3-methyl-1,5-pentanediol bis(3,5-dimethylcyclohexanecarboxylate), 3-methyl-1,5-pentanediol bis(4-tert-butylcyclohexanecarboxylate), 3-methyl-1,5-pentanediol bis(bicyclo[2.2.1]heptylcarboxylate), 2,4-diethyl-1,5-pentanediol di(cyclohexanecarboxylate), 2,4-diethyl-1,5-pentanediol bis(2-methylcyclohexanecarboxylate), 2,4-diethyl-1,5-pentanediol bis(3-methylcyclohexanecarboxylate), and 2,4-diethyl-1,5-pentanediol bis(4-methylcyclohexanecarboxylate) are preferable.

Of these, 2-methyl-1,3-propanediol di(cyclohexanecarboxylate), 2-methyl-1,3-propanediol bis(2-methylcyclohexanecarboxylate), 2-methyl-1,3-propanediol bis(3-methylcyclohexanecarboxylate), 2-methyl-1,3-propanediol bis(4-methylcyclohexanecarboxylate), 3-methyl-1,5-pentanediol di(cyclohexanecarboxylate), 3-methyl-1,5-pentanediol bis(2-methylcyclohexanecarboxylate), 3-methyl-1,5-pentanediol bis(3-methylcyclohexanecarboxylate), 3-methyl-1,5-pentanediol bis(4-methylcyclohexanecarboxylate), 2,4-diethyl-1,5-pentanediol di(cyclohexanecarboxylate), 2,4-diethyl-1,5-pentanediol bis(2-methylcyclohexanecarboxylate), 2,4-diethyl-1,5-pentanediol bis(3-methylcyclohexanecarboxylate), and 2,4-diethyl-1,5-pentanediol bis(4-methylcyclohexanecarboxylate) are more preferable.

One compound described above or a mixture of two or more compounds described above can be used in lubricant base oils for power transmission, such as lubricant base oils for traction drives, or lubricant base oils for continuously variable transmissions. Preferably, these compounds can be used in lubricant base oils for traction drives.

The method for producing the compound represented by formula (1) can be any method that can provide the compound. For example, the compound can be produced in accordance with the following reaction schemes 1 to 3.

Reaction Scheme 1

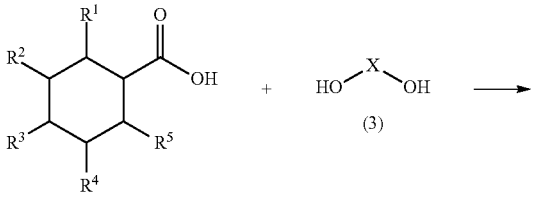

-continued

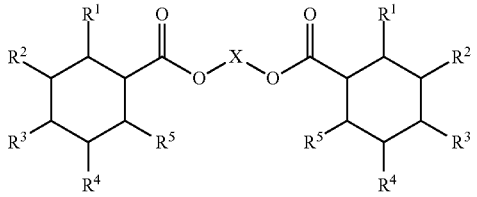

wherein $R^1$ to $R^5$ and X are as defined above.

Esterifying an alicyclic monocarboxylic acid represented by formula (2) or an ester compound thereof with a branched aliphatic diol represented by formula (3) (for an ester compound, transesterification) produces the compound represented by formula (1). The alicyclic monocarboxylic acid represented by formula (2) or an ester compound thereof and the branched aliphatic diol represented by formula (3) for use may be individually one single compound or a combination of two or more compounds.

Specific examples of the alicyclic monocarboxylic acid represented by formula (2) include cyclohexanecarboxylic acid, 2-methylcyclohexanecarboxylic acid, 3-methylcyclohexanecarboxylic acid, 4-methylcyclohexanecarboxylic acid, 2,3-dimethylcyclohexanecarboxylic acid, 2,4-dimethylcyclohexanecarboxylic acid, 2,5-dimethylcyclohexanecarboxylic acid, 2,6-dimethylcyclohexanecarboxylic acid, 3,4-dimethylcyclohexanecarboxylic acid, 3,5-dimethylcyclohexanecarboxylic acid, 2-tert-butyl cyclohexanecarboxylic acid, 3-tert-butyl cyclohexanecarboxylic acid, 4-tert-butyl cyclohexanecarboxylic acid, bicyclo[2.2.1]heptane-2-carboxylic acid, decahydronaphthalene-1-carboxylic acid, and decahydronaphthalene-2-carboxylic acid.

Examples of the ester compound of the alicyclic monocarboxylic acid represented by formula (2) include methyl ester or ethyl ester of the alicyclic monocarboxylic acid represented by formula (2).

Specific examples of the branched aliphatic diol represented by formula (3) include 2-methyl-1,3-propanediol, 2-ethyl-1,3-propanediol, 2-methyl-1,4-butanediol, 2-ethyl-1,4-butanediol, 2,3-dimethyl-1,4-butanediol, 2,3-diethyl-1,4-butanediol, 2-ethyl-3-methyl-1,4-butanediol, 2-methyl-1,5-pentanediol, 3-methyl-1,5-pentanediol, 2-ethyl-1,5-pentanediol, 3-ethyl-1,5-pentanediol, 2,3-dimethyl-1,5-pentanediol, 2,4-dimethyl-1,5-pentanediol, 2,3-diethyl-1,5-pentanediol, 2,4-diethyl-1,5-pentanediol, 2-ethyl-3-methyl-1,5-pentanediol, 2-ethyl-4-methyl-1,5-pentanediol, 3-ethyl-2-methyl-1,5-pentanediol, 2,3,4-trimethyl-1,5-pentanediol, 2,3,4-triethyl-1,5-pentanediol, 2-ethyl-3,4-dimethyl-1,5-pentanediol, 3-ethyl-2,4-dimethyl-1,5-pentanediol, 2,3-diethyl-4-methyl-1,5-pentanediol, 2,4-diethyl-3-methyl-1,5-pentanediol, 2-methyl-1,6-hexanediol, 3-methyl-1,6-hexanediol, 2-ethyl-1,6-hexanediol, 3-ethyl-1,6-hexanediol, 2-methyl-1,7-heptanediol, 3-methyl-1,7-heptanediol, 4-methyl-1,7-heptanediol, 2-ethyl-1,7-heptanediol, 3-ethyl-1,7-heptanediol, 4-ethyl-1,7-heptanediol, 2-methyl-1,8-octanediol, 3-methyl-1,8-octanediol, 4-methyl-1,8-octanediol, 2-ethyl-1,8-octanediol, 3-ethyl-1,8-octanediol, 4-ethyl-1,8-octanediol, 2-methyl-1,9-nonanediol, 3-methyl-1,9-nonanediol, 4-methyl-1,9-nonanediol, 5-methyl-1,9-nonanediol, 2-ethyl-1,9-nonanediol, 3-ethyl-1,9-nonanediol, 4-ethyl-1,9-nonanediol, 5-ethyl-1,9-nonanediol, 2-methyl-1,10-decanediol, 3-methyl-1,10-decanediol, 4-methyl-1,10-decanediol, 5-methyl-1,10-decanediol, 2-ethyl-1,10-decanediol, 3-ethyl-1,10-decanediol, 4-ethyl-1,10-decanediol, and 5-ethyl-1,10-decanediol.

Reaction Scheme 2

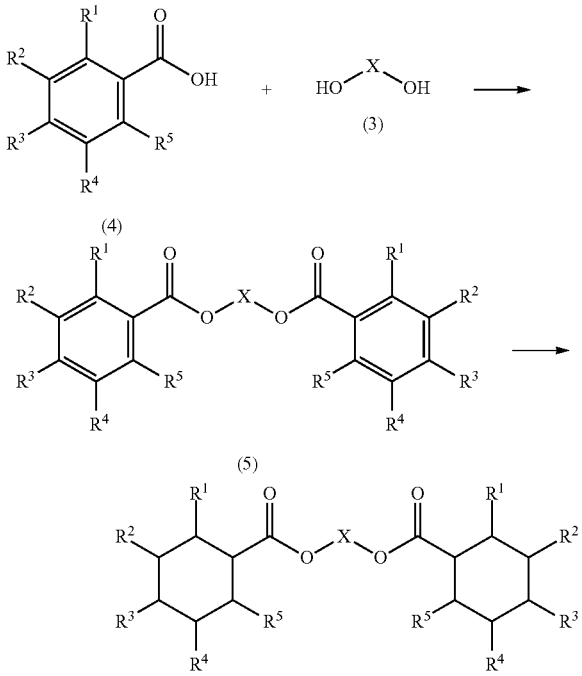

wherein $R^1$ to $R^5$ and X are as defined above.

Esterifying an aromatic monocarboxylic acid represented by formula (4) or an ester compound thereof with a branched aliphatic diol represented by formula (3) (for an ester compound, transesterification) produces an aromatic monocarboxylic acid diester compound represented by formula (5). Further, subjecting the benzene ring of the aromatic monocarboxylic acid diester compound represented by formula (5) to nucleus-hydrogenation reaction (reduction reaction) produces the compound represented by formula (1). The aromatic monocarboxylic acid represented by formula (4) or an ester compound thereof and the diol represented by formula (3) for use may be individually a single compound or a combination of two or more compounds.

Specific examples of the aromatic monocarboxylic acid represented by formula (4) include benzoic acid, 2-methylbenzoic acid, 3-methyl-benzoic acid, 4-methyl-benzoic acid, 2,3-dimethyl-benzoic acid, 2,4-dimethyl-benzoic acid, 2,5-dimethyl-benzoic acid, 2,6-dimethyl-benzoic acid, 3,4-dimethyl-benzoic acid, 3,5-dimethyl-benzoic acid, 2-tert-butylbenzoic acid, 3-tert-butyl-benzoic acid, 4-tert-butyl-benzoic acid, 1-naphthalene carboxylic acid, and 2-naphthalene carboxylic acid.

Examples of the ester compound of the aromatic monocarboxylic acid represented by formula (4) include methyl ester or ethyl ester of the aromatic monocarboxylic acid represented by formula (4).

Reaction Scheme 3

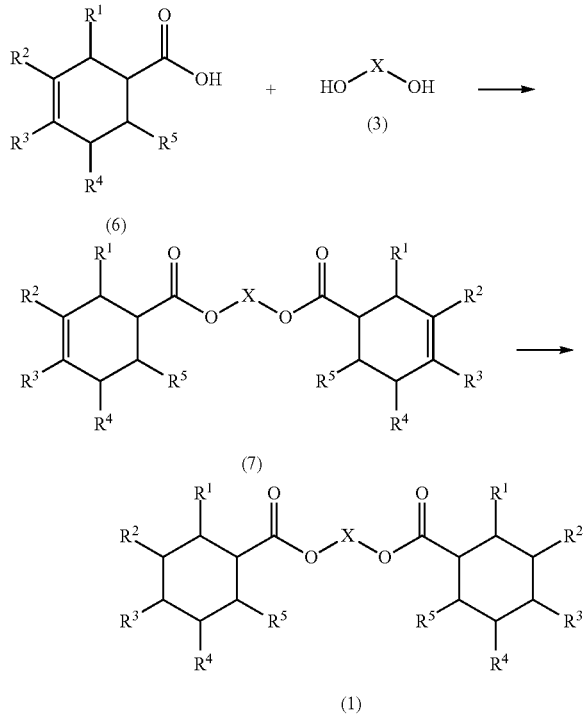

wherein $R^1$ to $R^5$ and X are as defined above.

Esterifying a cyclohexene monocarboxylic acid represented by formula (6) or an ester compound thereof with a branched aliphatic diol represented by formula (3) (for an ester compound, transesterification) produces a cyclohexene monocarboxylic acid diester compound represented by formula (7). Further, subjecting the double bond of the cyclohexene monocarboxylic acid diester compound represented by formula (7) to hydrogenation reaction produces the compound represented by formula (1). The cyclohexene monocarboxylic acid represented by formula (6) or an ester compound thereof and the diol represented by formula (3) for use may be individually a single compound or a combination of two or more compounds.

Specific examples of the cyclohexene monocarboxylic acid represented by formula (6) include 3-cyclohexenyl carboxylic acid, 2-methyl-3-cyclohexenyl carboxylic acid, 3-methyl-3-cyclohexenyl carboxylic acid, 4-methyl-3-cyclohexenyl carboxylic acid, 2,3-dimethyl-3-cyclohexenyl carboxylic acid, 2,4-dimethyl-3-cyclohexenyl carboxylic acid, 2,5-dimethyl-3-cyclohexenyl carboxylic acid, 2,6-dimethyl-3-cyclohexenyl carboxylic acid, 3,4-dimethyl-3-cyclohexenyl carboxylic acid, 3,5-dimethyl-3-cyclohexenyl carboxylic acid, 2-tert-butyl-3-cyclohexenyl carboxylic acid, 3-tert-butyl-3-cyclohexenyl carboxylic acid, 4-tert-butyl-3-cyclohexenyl carboxylic acid, and bicyclo[2.2.1]hept-5-ene-2-carboxylic acid Examples of the ester compound of the cyclohexene monocarboxylic acid represented by formula (6) include methyl ester or ethyl ester of the cyclohexene monocarboxylic acid represented by formula (6).

Of the production methods above, the production method in accordance with reaction scheme 1 is preferable.

The compound represented by formula (1) has an acid value of preferably 0.1 mg KOH/g or less, and more preferably 0.05 mg KOH/g or less. The compound represented by formula (1) having an acid value of 0.1 mg KOH/g or less tends to exhibit increased heat resistance of the compound itself, and an acid value within these preferable ranges positively affects the improvement of thermal oxidation stability of the base oil according to the present invention. Examples of the method for reducing the acid value include a method of sufficiently advancing the reaction, a method of performing neutralization with an alkali component and washing with water (a method including washing (neutralizing) with an alkali aqueous solution (e.g., an aqueous sodium hydroxide solution) and washing with water) during a post-treatment, and a method of performing adsorption treatment on an acid component using activated alumina.

The compound represented by formula (1) has a hydroxy value of preferably 2 mg KOH/g or less, and more preferably 1 mg KOH/g or less. The compound represented by formula (1) having a hydroxy value of 2 mg KOH/g or less tends to exhibit a lower hygroscopicity of the compound itself, and exhibit more increased heat resistance. A hydroxy value within these preferable ranges positively affects the improvement of water resistance and thermal oxidation resistance stability of the base oil according to the present invention. Examples of the method for reducing the hydroxyl value include a method of sufficiently advancing the reaction, and a method of distilling off the diol component as a starting material under reduced pressure (a method including distilling off a distillable excessive starting material etc. described above under reduced or atmospheric pressure) during a post-treatment.

The lubricant base oil for power transmission has a traction coefficient (60° C.) of typically 0.090 or more, and preferably 0.100 or more. In the present specification and the claims, "traction coefficient (60° C.)" refers to a value as measured in accordance with the method described later in the Examples.

The low-temperature fluidity of the lubricant base oil for power transmission can be evaluated, for example, according to its pour point. The pour point of the lubricant base oil is typically −30° C. or less, and preferably −40° C. or less, from the standpoint of operability at low temperatures. In the present specification and the claims, the pour point refers to a value as measured in accordance with the method described later in the Examples.

The flash point of the lubricant base oil for power transmission is typically 200° C. or more, and preferably 220° C. or more, from the standpoint of storage stability and handling. There are many restrictions on handling lubricant base oils having a flash point of less than 200° C. due to ignition. In the present specification and the claims, the flash point refers to a value as measured in accordance with the method described later in the Examples.

The lubricant base oil for power transmission is preferably a lubricant base oil for power transmission with a traction coefficient (60° C.) of 0.100 or more, a pour point of −30° C. or less, and a flash point of 200° C. or more; a lubricant base oil for power transmission with a traction coefficient (60° C.) of 0.090 or more, a pour point of −40° C. or less, and a flash point of 200° C. or more; and a lubricant base oil for power transmission with a traction coefficient (60° C.) of 0.090 or more, a pour point of −30° C. or less, and a flash point of 220° C. or more. The lubricant base oil for power transmission is more preferably a lubricant base oil for power transmission with a traction coefficient (60° C.) of 0.100 or more, a pour point of −40° C. or less, and a flash point of 200° C. or more; a lubricant base oil for power transmission with a traction coefficient (60° C.) of 0.100 or more, a pour point of −30° C. or less, and a flash point of 220° C. or more; and a lubricant base oil for power transmission with a traction coefficient (60° C.) of 0.090 or more, a pour point of −40° C. or less, and a flash point of 220° C. or more. The lubricant base oil for power transmission is particularly preferably a lubricant base oil for power transmission with a traction coefficient (60° C.) of 0.100 or more, a pour point of −40° C. or less, and a flash point of 220° C. or more. In the present specification and the claims, the traction coefficient (60° C.), the pour point, and the flash point refer to a value as measured in accordance with the methods described later in the Examples.

Due to its high traction coefficient and high flash point and excellent low-temperature fluidity, the lubricant base oil for power transmission is suitably used in lubricant base oils for power transmission, in particular lubricant base oils for traction drives.

The lubricant base oil for power transmission may contain other base oils usable in combination ("additional base oil" below). Specifically, the lubricant base oil for power transmission according to the present invention encompasses the compound represented by formula (1) alone and a combination of the compound represented by formula (1) and one or more additional base oils. The lubricant base oil for power transmission preferably does not contain additional base oils. The lubricant base oil for power transmission may also be referred to as "base oil" below.

Examples of additional base oils include mineral oils (e.g., hydrocarbon oils obtained by purifying petroleum); poly-α-olefins; polybutenes; alkylbenzenes; alkylnaphthalenes; alicyclic hydrocarbon oils; synthetic hydrocarbon oils, such as isomerized oils of synthetic hydrocarbons obtained by the Fischer-Tropsch process; animal and vegetable oils; organic acid esters other than the compound represented by formula (1); polyalkylene glycols; ether-based base oils, such as polyvinyl ethers, polyphenyl ethers, and alkylphenyl ethers; and silicone oils. At least one of these additional base oils may suitably be used in combination.

Examples of mineral oils include solvent-refined mineral oils, mineral oils refined by hydrogenation, and isomerized wax oils; typically, usable mineral oils are those having a kinetic viscosity within the range of 1 to 25 $mm^2/s$, and preferably 2 to 20 $mm^2/s$ at 100° C.

Examples of poly-α-olefins include polymers or copolymers of α-olefins having 2 to 16 carbon atoms (e.g., ethylene, propylene, 1-butene, 1-hexene, 1-octene, 1-decene, 1-dodecene, 1-tetradecene, and 1-hexadecene) that have a kinetic viscosity of 1 to 25 $mm^2/s$ at 100° C. and a viscosity index of 100 or more, and preferably a kinetic viscosity of 1.5 to 20 $mm^2/s$ at 100° C. and a viscosity index of 120 or more.

Examples of polybutenes include those obtained by polymerizing isobutylene, or obtained by copolymerizing isobutylene with normal butylene, typically those having a kinetic viscosity within the wide range of 2 to 40 $mm^2/s$ at 100° C.

Examples of alkylbenzenes include benzenes substituted with $C_{1-40}$ linear or branched alkyl, such as monoalkylbenzenes, dialkylbenzenes, trialkylbenzenes, and tetraalkylbenzenes that all have a molecular weight of 200 to 450.

Examples of alkylnaphthalenes include naphthalenes substituted with $C_{1-30}$ linear or branched alkyl, such as monoalkylnaphthalenes and dialkylnaphthalenes.

Examples of animal and vegetable oils include beef tallow, lard, palm oil, coconut oil, rapeseed oil, castor oil, and sunflower oil.

Examples of organic acid esters other than the compound represented by formula (1) include fatty acid monoesters, aliphatic dibasic acid diesters, aliphatic dihydric alcohol diesters (excluding the compound represented by formula (1)), polyol esters, and other esters.

Examples of fatty acid monoesters include esters of a $C_{5-22}$ aliphatic linear or branched monocarboxylic acid with a $C_{3-22}$ linear or branched saturated or unsaturated aliphatic alcohol.

Examples of aliphatic dibasic acid diesters include diesters of a $C_{3-22}$ linear or branched saturated or unsaturated aliphatic alcohol with an aliphatic dibasic acid, such as oxalic acid, malonic acid, succinic acid, glutaric acid, adipic acid, pimelic acid, suberic acid, azelaic acid, sebacic acid, 1,9-nonamethylenedicarboxylic acid, or 1,10-decamethylenedicarboxylic acid, or an anhydride of the aliphatic dibasic acid.

Examples of aliphatic dihydric alcohol diesters (excluding the compound represented by formula (1)) and polyol esters include full esters of a polyol that has a neopentyl structure or a polyol that has a non-neopentyl structure with a $C_{3-22}$ linear or branched saturated or unsaturated fatty acid. Examples of polyols that have a neopentyl structure include neopentyl glycol, 2,2-diethylpropanediol, 2-butyl-2-ethylpropanediol, trimethylolethane, trimethylolpropane, pentaerythritol, ditrimethylolpropane, and dipentaerythritol. Examples of polyols that have a non-neopentyl structure include 1,3-propanediol, 1,4-butanediol, 1,5-pentanediol, 1,6-hexanediol, 1,7-heptanediol, 1,8-octanediol, 1,9-nonanediol, 1,10-decanediol, 1,2-propanediol, 2-methyl-1,3-propanediol, 1,3-butanediol, 2-methyl-1,4-butanediol, 1,4-pentanediol, 2-methyl-1,5-pentanediol, 3-methyl-1,5-pentanediol, 1,5-hexanediol, 2-methyl-1,6-hexanediol, 3-methyl-1,6-hexanediol, 1,6-heptanediol, 2-methyl-1,7-heptanediol, 3-methyl-1,7-heptanediol, 4-methyl-1,7-heptanediol, 1,7-octanediol, 2-methyl-1,8-octanediol, 3-methyl-1,8-octanediol, 4-methyl-1,8-octanediol, 1,8-nonanediol, 2-methyl-1,9-nonanediol, 3-methyl-1,9-nonanediol, 4-methyl-1,9-nonanediol, 5-methyl-1,9-nonanediol, 2-ethyl-1,3-hexanediol, 2,4-diethyl-1,5-pentanediol, glycerin, polyglycerol, and sorbitol.

Examples of other esters include esters of a polymerized fatty acid such as a dimer acid or a hydrogenated dimer acid, or a hydroxy fatty acid such as a condensed castor oil fatty acid or a hydrogenated condensed castor oil fatty acid, with a $C_{3-22}$ linear or branched saturated or unsaturated aliphatic alcohol.

Examples of polyalkylene glycols include a polymer prepared from an alcohol and one or more $C_{2-4}$, linear or branched alkylene oxides by ring-opening polymerization. Examples of alkylene oxides include ethylene oxide, propylene oxide, and butylene oxide; polymers prepared from one of these, or copolymers prepared from a mixture of two or more of these are usable. Compounds that have the hydroxy group(s) at one or both ends etherified are also usable. The polymers have a kinetic viscosity of preferably 5 to 1000 $mm^2/s$ (40° C.), and more preferably 5 to 500 $mm^2/s$ (40° C.)

Polyvinyl ethers are, for example, compounds obtained by polymerizing a vinyl ether monomer. Examples of monomers include methyl vinyl ether, ethyl vinyl ether, isopropyl vinyl ether, n-butyl vinyl ether, isobutyl vinyl ether, sec-butyl vinyl ether, tert-butyl vinyl ether, n-pentyl vinyl ether, n-hexyl vinyl ether, 2-methoxyethyl vinyl ether, and 2-ethoxyethyl vinyl ether. The polymers have a kinetic viscosity of preferably 5 to 1000 $mm^2/s$ (40° C.), and more preferably 5 to 500 $mm^2/s$ (40° C.).

Examples of polyphenyl ethers include compounds that have a structure in which the meta positions of two or more aromatic rings are connected through ether linkages or thioether linkages; specific examples include bis(m-phenoxyphenyl)ether, m-bis(m-phenoxyphenoxy)benzene, and thioethers in which one or more oxygen atoms of these compounds are replaced by one or more sulfur atoms.

Examples of alkylphenyl ethers include polyphenyl ethers substituted with one or more $C_{6-18}$ linear or branched alkyl group; in particular, diphenyl ethers substituted with one or more alkyl groups are preferable.

Examples of silicone oils include dimethyl silicone, methylphenyl silicone, and modified silicones such as long-chain alkyl silicone and fluorosilicone.

The content of the compound represented by formula (1) in the lubricant base oil for power transmission according to the present invention is typically 70 mass % or more, preferably 80 mass % or more, more preferably 90 mass % or more, and still more preferably 95 mass % or more.

The content of the additional base oil in the lubricant base oil for power transmission is typically 30 mass % or less, preferably 20 mass % or less, more preferably 10 mass % or less, and still more preferably 5 mass % or less.

The present invention also provides a lubricant oil for power transmission containing the lubricant base oil for power transmission. To improve its performance, the lubricant oil for power transmission may suitably contain, in addition to the base oil, for example, at least one additive selected from the group consisting of antioxidants, metal detergents, ashless dispersants, oiliness agents, antiwear agents, extreme-pressure agents, metal deactivators, rust inhibitors, viscosity index improvers, pour point depressants, antifoaming agents, hydrolysis inhibitors, thickeners, corrosion inhibitors, and hue stabilizers. The amounts of such additives are not particularly limited as long as the effects of the present invention are brought about; specific examples are as described below.

Examples of antioxidants include 2,6-di-tert-butylphenol, 2,6-di-tert-butyl-p-cresol, 4,4'-methylenebis(2,6-di-tert-butylphenol), 4,4'-butylidenebis(3-methyl-6-tert-butylphenol), 2,2'-methylenebis(4-ethyl-6-tert-butylphenol), 2,2'-methylenebis(4-methyl-6-tert-butylphenol), 4,4'-isopropylidenebisphenol, 2,4-dimethyl-6-tert-butylphenol, tetrakis[methylene-3-(3,5-di-tert-butyl-4-hydroxyphenyl) propionate]methane, 1,1,3-tris(2-methyl-4-hydroxy-5-tert-butylphenyl)butane, 1,3,5-trimethyl-2,4,6-tris(3,5-di-tert-butyl-4-hydroxybenzyl)benzene, 2,2'-dihydroxy-3,3'-di(α-methylcyclohexyl)-5,5'-dimethyl-diphenylmethane, 2,2'-isobutylidenebis(4,6-dimethylphenol), 2,6-bis(2'-hydroxy-3'-tert-butyl-5'-methylbenzyl)-4-methylphenol, 1,1'-bis(4-hydroxyphenyl)cyclohexane, 2,5-di-tert-amylhydroquinone, 2,5-di-tert-butylhydroquinone, 1,4-dihydroxyanthraquinone, 3-tert-butyl-4-hydroxyanisole, 2-tert-butyl-4-hydroxyanisole, 2,4-dibenzoylresorcinol, 4-tert-butylcatechol, 2,6-di-tert-butyl-4-ethylphenol, 2-hydroxy-4-methoxybenzophenone, 2,4-dihydroxybenzophenone, 2,2'-dihydroxy-4-methoxybenzophenone, 2,4,5-trihydroxybenzophenone, α-tocopherol, bis[2-(2-hydroxy-5-methyl-3-tert-butylbenzyl)-4-methyl-6-tert-butylphenyl]terephthalate, triethyleneglycol bis[3-(3-tert-butyl-5-methyl-4-hydroxyphenyl) propionate], 1,6-hexanediol-bis[3-(3,5-di-tert-butyl-4-hydroxyphenyl)propionate]; monoalkyl diphenylamines, such as diphenylamine, monobutyl (including linear and branched) diphenylamines, monopentyl (including linear and branched) diphenylamines, monohexyl (including linear and branched) diphenylamines, monoheptyl (including linear and branched) diphenylamines, and monooctyl (including linear and branched) diphenylamines, in particular, mono($C_{4-9}$ alkyl)diphenylamines (i.e., diphenylamines wherein one of the two benzene rings is mono-substituted with an alkyl group, in particular, a $C_{4-9}$ alkyl group, i.e., a monoalkyl-substituted diphenylamines); di(alkylphenyl) amines, such as p,p'-dibutyl (including linear and branched) diphenylamines, p,p'-dipentyl (including linear and branched) diphenylamines, p,p'-dihexyl (including linear and branched) diphenylamines, p,p'-diheptyl (including linear and branched) diphenylamines, p,p'-dioctyl (including linear and branched) diphenylamines, (including linear and branched) diphenylamines, in particular, p,p'-di($C_{4-9}$ alkylphenyl)amines (i.e., dialkyl-substituted diphenylamines wherein each of the two benzene rings is mono-substituted with an alkyl group, in particular, a $C_{4-9}$ alkyl group, and the two alkyl groups are identical), di(mono alkylphenyl)amines wherein the alkyl group on one of the benzene rings is different from the alkyl group on the other of the benzene rings, di(di-$C_{4-9}$ alkylphenyl)amines wherein at least one of the four alkyl groups on the two benzene rings is different from the rest of the alkyl groups; naphthylamines such as N-phenyl-1-naphthylamine, N-phenyl-2-naphthylamine, 4-octylphenyl-1-naphthylamine, and 4-octylphenyl-2-naphthylamine; and phenylenediamine compounds such as p-phenylenediamine, N-phenyl-N'-isopropyl-p-phenylenediamine, and N-phenyl-N'-(1,3-dimethylbutyl)-p-phenylenediamine. In this paragraph and the following paragraph, "including linear and branched" means including either linear alkyl or branched alkyl, or both.

Of these, in particular, thiodipropionic acid esters, such as p,p'-dioctyl (including linear and branched) diphenylamines, N-dinonyl (including linear and branched) diphenylamines, N-phenyl-1-naphthylamine, di(n-dodecyl) thiodipropionate, and di(n-octadecyl)thiodipropionate, and sulfur-based compounds, such as phenothiazine, can be listed as preferable examples. These antioxidants may be used singly, or in a combination of two or more. Adding an antioxidant to the lubricant base oil for power transmission suppresses the decomposition of the base oil in the presence of air, thereby improving the heat resistance of the lubricant oil for power transmission. The amount of the antioxidant(s) to be added is typically about 0.01 to 5 mass %, and preferably about 0.05 to 3 mass; based on the base oil.

The present specification and the claims may occasionally define the range of additive content by using the phrase "based on the base oil," such as in the expression "0.01 to 5 mass % based on the base oil." The term "base oil" used herein means either a base oil consisting only of the compound represented by formula (1), or a base oil composed of a mixture of the compound represented by formula (1) and an additional base oil. For example, the expression "0.01 to 5 mass % based on the base oil" is synonymous with "0.01 to 5 parts by mass based on 100 parts by mass of the base oil."

Examples of metal detergents include metal sulfonates, such as Ca-petroleum sulfonate, overbased Ca-petroleum sulfonate, Ca-alkylbenzene sulfonate, overbased Ca-alkylbenzene sulfonate, Ba-alkylbenzene sulfonate, overbased Ba-alkylbenzene sulfonate, Mg-alkylbenzene sulfonate, overbased Mg-alkylbenzene sulfonate, Na-alkylbenzene sulfonate, overbased Na-alkylbenzene sulfonate, Ca-alkylnaphthalene sulfonate, and overbased Ca-alkylnaphthalene sulfonate; metal phenates, such as Ca-phenate, overbased Ca-phenate, Ba-phenate, and overbased Ba-phenate; metal salicylates, such as Ca-salicylate, and overbased Ca-salicylate; metal phosphonates, such as Ca-phosphonate, overbased Ca-phosphonate, Ba-phosphonate, and overbased Ba-phosphonate; and overbased Ca-carboxylates. These metal detergents can be used singly or in a combination of two or more. The amount of a metal detergent to be added is typically about 1 to 10 mass %, and preferably about 2 to 7 mass %, based on the base oil.

Examples of ashless dispersants include polyalkenyl succinimides, polyalkenyl succinamides, polyalkenyl benzylamines, and polyalkenyl succinic acid esters. These ashless dispersants can be used singly, or in combination of two or more. The amount of the ashless dispersant(s) to be added is typically 1 to 10 mass %, and preferably 2 to 7 mass %, based on the base oil.

Examples of oiliness agents include saturated or unsaturated aliphatic monocarboxylic acids, such as stearic acid and oleic acid; polymerized fatty acids, such as dimer acid and hydrogenated dimer acid; hydroxyfatty acids, such as ricinoleic acid and 12-hydroxystearic acid; saturated or unsaturated aliphatic monoalcohols, such as lauryl alcohol and oleyl alcohol; saturated or unsaturated aliphatic monoamines, such as stearyl amine and oleyl amine; saturated or unsaturated aliphatic monocarboxylic acid amides, such as lauramide and oleamide; glycerin ethers, such as batyl alcohol, chimyl alcohol, and selachyl alcohol; alkyl or alkenyl polyglyceryl ethers, such as lauryl polyglycerol ether and oleyl polyglyceryl ether; and poly(alkylene oxide) adducts of alkyl or alkenylamine, such as di(2-ethylhexyl) monoethanolamine and diisotridecyl monoethanolamine. These oiliness agents can be used singly, or in combination of two or more. The amount of the oiliness agent(s) to be added is typically 0.01 to 5 mass %, and preferably 0.1 to 3 mass %, based on the base oil.

Examples of antiwear agents and extreme-pressure agents include phosphorus-based compounds, sulfur-based compounds, and organometallic compounds. Examples of phosphorus-based compounds include phosphate esters, such as tricresyl phosphate, cresyldiphenyl phosphate, alkylphenyl phosphates, tributyl phosphate, and dibutyl phosphate; phosphite esters, such as tributyl phosphite, dibutyl phosphite, and triisopropyl phosphite; and amine salts thereof. Examples of sulfur-based compounds include sulfurized fatty acids, such as sulfurized oils and fats, and sulfurized oleic acid; di-benzyl disulfide; sulfurized olefins; and dialkyl disulfide. Examples of organometallic compounds include Zn-dialkyldithio phosphates, Zn-dialkyldithio phosphates, Mo-dialkyldithio phosphates, and Mo-dialkyldithio carbamates. These antiwear agents can be used singly or in combination. The amount of the antiwear agent(s) to be added is typically 0.01 to 10 mass %, and preferably 0.1 to 5 mass %, based on the base oil.

Examples of metal deactivators include benzotriazole-based compounds, thiadiazole-based compounds, and gallic acid ester-based compounds. These metal deactivators can be used singly, or in combination of two or more. The amount of the metal deactivator(s) to be added is typically 0.01 to 0.4 mass %, and preferably 0.01 to 0.2 mass %, based on the base oil.

Examples of rust inhibitors include alkyl or alkenyl succinic acid derivatives, such as dodecenylsuccinic acid half-esters, octadecenylsuccinic anhydride, and dodecenylsuccinic amide; partial esters of polyhydric alcohols, such as sorbitan monooleate, glycerol monooleate, and pentaerythritol monooleate; metal sulfonates, such as Ca-petroleum sulfonate, Ca-alkylbenzene sulfonate, Ba-alkylbenzene sulfonate, Mg-alkylbenzene sulfonate, Na-alkyl-benzene sulfonate, Zn-alkylbenzene sulfonate, and Ca-alkylnaphthalene sulfonate; amines, such as rosin amine and N-oleyl sarcosine; and dialkyl phosphite amine salts. These rust inhibitors can be used singly, or in combination of two or more. The amount of the rust inhibitor(s) to be added is typically 0.01 to 5 mass %, and preferably 0.05 to 2 mass %, based on the base oil.

Examples of viscosity index improvers include olefin copolymers, such as polyalkylmethacrylates, polyalkylstyrenes, polybutenes, ethylene-propylene copolymers, styrene-diene copolymers, and styrene-maleic anhydride ester copolymers. These viscosity index improvers can be used singly, or in combination of two or more. The amount of the viscosity index improver(s) to be added is typically 0.1 to 15 mass %, and preferably 0.5 to 7 mass %, based on the base oil.

Examples of pour point depressants include condensates of chlorinated paraffin and alkylnaphthalene; condensates of chlorinated paraffin and phenol; and polyalkylmethacrylates, polyalkylstyrenes, polybutenes, etc., which are also viscosity index improvers as mentioned above. These pour point depressants can be used singly, or in combination of two or more. The amount of the pour point depressant(s) to be added is typically about 0.01 to 5 mass %, preferably about 0.1 to 3 mass %, based on the base oil.

Examples of antifoaming agents include liquid silicones. The amount of an antifoaming agent to be added is typically 0.0005 to 0.01 mass % based on the base oil.

Examples of hydrolysis inhibitors include epoxy compounds, such as alkyl glycidyl ethers, alkyl glycidyl esters, alkylene glycol glycidyl ethers, alicyclic epoxides, and phenyl glycidyl ether; and carbodiimide compounds, such as di-tert-butylcarbodiimide and 1,3-di-p-tolylcarbodiimide. These hydrolysis inhibitors can be used singly or in a combination of two or more. The amount of the hydrolysis inhibitor(s) to be added is typically 0.05 to 2 mass % based on the base oil.

The lubricant base oil for power transmission can be combined with a thickener to form grease.

Examples of thickeners include soap-based thickeners, such as sodium soap, lithium soap, calcium soap, calcium complex soap, aluminum complex soap, and lithium complex soap; and nonsoap thickeners, such as bentonite, silica aerogel, sodium terephthalamate, urea compounds, polytetrafluoroethylene, and boron nitride.

Examples of soap-based thickeners include metal soap-based thickeners and complex soap-based thickeners. Examples of metal soap-based thickeners include hydroxyl-containing aliphatic carboxylic acid lithium salts, such as lithium-12-hydroxystearate; aliphatic carboxylic acid lithium salts, such as lithium stearate; and mixtures thereof.

Examples of complex soap-based thickeners include complexes of a hydroxy-containing monovalent aliphatic carboxylic acid metal salt and a divalent aliphatic carboxylic acid metal salt. Specific examples include a lithium complex soap and an aluminum complex soap.

Examples of urea compounds include alicyclic compounds, aromatic compounds, aliphatic compounds, diurea compounds, triurea compounds, tetraurea compounds, and urea-urethane compounds.

Of these, lithium soap, lithium complex soap, and urea compounds are preferable as a thickener. Urea compounds are particularly preferable from the standpoint of heat resistance.

These thickeners may be used singly, or in a suitable combination of two or more. The amount of the thickener(s) to be added can be any amount as long as the predetermined effects are brought about.

Examples of corrosion inhibitors include sodium sulfonate and sorbitan ester. A corrosion inhibitor or a combination of two or more corrosion inhibitors is added typically in an amount of about 0.1 to 3.0 mass % based on the base oil.

Examples of hue stabilizers include substituted hydroquinones and furfural azine. A hue stabilizer or a combination of two or more hue stabilizers is added typically in an amount of about 0.01 to 0.1 mass % based on the base oil.

As described above, the lubricant oil for power transmission according to the present invention thus obtained is suitable for a lubricant oil for traction drives because it contains a base oil having a high traction coefficient and a high flash point and excellent low-temperature fluidity.

Adding the lubricant base oil for power transmission according to the present invention to a lubricant oil for power transmission (in particular, a lubricant oil for traction drives) increases the traction coefficient of the lubricant oil for power transmission. Thus, the lubricant base oil for power transmission can also be used as a traction coefficient improver.

Due to its high power transmission performance and low vibration or noise, as well as high flash point, the lubricant oil for power transmission according to the present invention can be used in a lubricant oil for traction drives (i.e., power transmission devices composed of two or more rotors). Examples of equipment that uses a traction drive include motors, transmissions, generators, and speed reducers of automobiles, marine vessels, aircraft, precision equipment, and robots.

EXAMPLES

The present invention is described in detail below with reference to Examples; however, the present invention is not limited to these Examples. The physical and chemical characteristics of the lubricant base oils and lubricant oil compositions of the Examples were evaluated in accordance with the methods described below. Compounds that are not specifically detailed are commercially available reagents.

Compounds for Use

Cyclohexanecarboxylic acid: produced by Sigma-Aldrich

2-Methylcyclohexanecarboxylic acid: produced by Sigma-Aldrich

3-Methylcyclohexanecarboxylic acid: produced by Sigma-Aldrich 4-methylcyclohexanecarboxylic acid: produced by Sigma-Aldrich 3,4-Dimethylcyclohexanecarboxylic acid: With reference to JPS49-135950, 3,4-dimethylbenzoic acid (produced by Tokyo Chemical Industry Co., Ltd.) was subjected to hydrogenation reaction in the presence of a 5 mass; palladium-carbon catalyst, and the obtained crude product was purified by distillation, thereby obtaining 3,4-dimethylcyclohexanecarboxylic acid.

3,5-Dimethylcyclohexanecarboxylic acid: With reference to JPS49-135950, 3,5-dimethylbenzoic acid (produced by Tokyo Chemical Industry Co., Ltd.) was subjected to hydrogenation reaction in the presence of a 5 mass % palladium-carbon catalyst, and the obtained crude product was purified by distillation, thereby obtaining 3,5-dimethylcyclohexanecarboxylic acid.

4-Tert-butyl cyclohexanecarboxylic acid: produced by Tokyo Chemical Industry Co., Ltd.

Bicyclo[2.2.1]heptane-2-carboxylic acid: produced by Fuji Film Wako Pure Chemical industries, Ltd.

2-Methyl-1,3-propanediol: produced by Tokyo Chemical industry Co., Ltd.

3-Methyl-1,5-pentanediol: produced by Tokyo Chemical industry Co., Ltd.

2,4-Diethyl-1,5-pentanediol: produced by Tokyo Chemical Industry Co., Ltd.

1,3-Butanediol: produced by Tokyo Chemical Industry Co., Ltd.

2,2-Dimethyl-1,3-propanediol: produced by Tokyo Chemical Industry Co., Ltd.

Adipic acid diisodecyl: produced by New Japan Chemical Co., Ltd., trade name: SANSO CIZER DIDA Mineral oil Y: produced by SK Lubricants, trade name: YUBASE 3 (industrial liquid paraffin of saturated hydrocarbons)

(a) Acid Value (AV)

The acid value was measured in accordance with JIS K2501 (2003). The detection limit is 0.01 KOH mg/g.

(b) Hydroxy Value (OHV)

The hydroxy value was measured in accordance with JIS K0070 (1992). The detection limit is 0.1 KOH mg/g.

Measurement of Physical Properties of Lubricant Base Oil (c) Traction Coefficient The maximum traction coefficient was measured in a test using the following device under the following conditions, and determined to be the traction coefficient (60° C.)

Measurement Conditions

Device: ball-on-ring wear tester (model TE54, produced by Phoenix Tribology)

Test piece shape:upper test piece:25-mm-diameter sphere; lower test piece: 50-mm-diameter ring Test piece material: SUJ2

Slip ratio: 5%

Sample temperature: 60° C.

Load: 200 N

Evaluation of Traction Coefficient

A: 0.100 or more

B: 0.090 or more and less than 0.100

C: less than 0.090

(d) Low-Temperature Fluidity Test (Pour Point)

The pour point was measured in accordance with JIS-K-2269 (1987).

Evaluation of Low-Temperature Fluidity

A: −40° C. or below

B: over −40° C. and −30° C. or below

C: over −30° C.

(e) Flash Point

The flash point was measured in accordance with JIS K2265 (Cleveland open cup method).

Evaluation of Flash Point

A: 220° C. or higher

B: 200° C. or higher and below 220° C.

C: below 200° C.

(f) Evaluation of Lubricant Base Oil for Power Transmission

The evaluation of a lubricant base oil for power transmission was made as follows: in the evaluation of traction coefficient, the evaluation of low-temperature fluidity, and the evaluation of flash point, if at least one evaluation was rated C, the lubricant base oil was determined to be inappropriate. If two or fewer evaluations were rated B (the remaining evaluation being rated A), the base oil was determined to be good. If one or no evaluation was rated B (the remaining evaluations being rated A), the base oil was determined to be particularly good.

Example 1

469.2 g (3.30 mol) of 3-methylcyclohexanecarboxylic acid as alicyclic monocarboxylic acid, 135.2 g (1.50 mol) of 2-methyl-1,3-propanediol as a branched aliphatic diol, 0.5 g of tin oxide as an esterification catalyst, and 30 g of xylene as an entrainer were placed in a 1-L four-necked flask equipped with a stirrer, a thermometer, and a water fraction receiver with a cooling pipe. After the inside of the flask was purged with nitrogen, the mixture was gradually heated to 230° C. Esterification reaction was performed by removing distilled water using the water fraction receiver with reference to the theoretical water amount (54.0 g), while adjusting the decompression degree so that the xylene was refluxed. After completion of the reaction, the remaining 3-methylcyclohexanecarboxylic acid and xylene were removed by distillation under reduced pressure, thereby obtaining a crude esterified product. The crude esterified product was neutralized with an aqueous caustic soda solution in an amount of 1.5-fold equivalents relative to the acid value of the crude esterified product, and then the crude esterified product was repeatedly washed with water until it was neutral. After magnesium sulfate was added to the obtained crude esterified product to dehydrate it, the magnesium sulfate was removed by filtration, thereby obtaining 409.6 g (1.21 mol) of 2-methyl-1,3-propanediol bis(3-methyl-cyclohexanecarboxylate). The obtained compound had an acid value of 0.01 mg KOH/g or less, and a hydroxyl value of 1 mg KOH/g or less. Table 1 illustrates the physical properties of the compound evaluated as lubricant base oil for power transmission (A).

Example 2

The procedure of Example 1 was repeated except that 3-methylcyclohexanecarboxylic acid was changed to 423.0 g (3.3 mol) of cyclohexanecarboxylic acid, and 2-methyl-1,3-propanediol was changed to 177.3 g (1.5 mol) of 3-methyl-1,5-pentanediol, thereby obtaining 440.0 g (1.30 mol) of 3-methyl-1,5-pentanediol di(cyclohexanecarboxylate). The obtained compound had an acid value of 0.01 mg KOH/g or less and a hydroxy value of 1 mg KOH/g or less. Table 1 illustrates the physical properties of the compound evaluated as lubricant base oil for power transmission (B).

Example 3

The procedure of Example 1 was repeated except that 3-methylcyclohexanecarboxylic acid was changed to 469.2 g (3.3 mol) of 2-methylcyclohexanecarboxylic acid, and 2-methyl-1,3-propanediol was changed to 177.3 g (1.5 mol) of 3-methyl-1,5-pentanediol, thereby obtaining 465.5 g (1.27 mol) of 3-methyl-1,5-pentanediol bis(2-methyl-cyclohexanecarboxylate). The obtained compound had an acid value of 0.01 mg KOH/g or less and a hydroxy value of 1 mg KOH/g or less. Table 1 illustrates the physical properties of the compound evaluated as lubricant base oil for power transmission (C).

Example 4

The procedure of Example 1 was repeated except that 2-methyl-1,3-propanediol was changed to 177.3 g (1.5 mol) of 3-methyl-1,5-pentanediol, thereby obtaining 487.5 g (1.33 mol) of 3-methyl-1,5-pentanediol bis(3-methylcyclohexanecarboxylate). The obtained compound had an acid value of 0.01 mg KOH/g or less and a hydroxy value of 1 mg KOH/g or less. Table 1 illustrates the physical properties of the compound evaluated as lubricant base oil for power transmission (D).

Example 5

The procedure of Example 1 was repeated except that 3-methylcyclohexanecarboxylic acid was changed to 469.2 g (3.3 mol) of 4-methylcyclohexanecarboxylic acid, and 2-methyl-1,3-propanediol was changed to 177.3 g (1.5 mol) of 3-methyl-1,5-pentanediol, thereby obtaining 498.5 g (1.36 mol) of 3-methyl-1,5-pentanediol bis(4-methylcyclohexanecarboxylate). The obtained compound had an acid value of 0.01 mg KOH/g or less and a hydroxy value of 1 mg KOH/g or less. Table 1 illustrates the physical properties of the compound evaluated as lubricant base oil for power transmission (E).

Example 6

The procedure of Example 1 was repeated except that 3-methylcyclohexanecarboxylic acid was changed to 423.0 g (3.3 mol) of cyclohexanecarboxylic acid, and 2-methyl-1,3-propanediol was changed to 240.4 g (1.5 mol) of 2,4-diethyl-1,5-pentanediol, thereby obtaining 532.8 g (1.40 mol) of 2,4-diethyl-1,5-pentanediol di(cyclohexanecarboxylate). The obtained compound had an acid value of 0.01 mg KOH/g or less and a hydroxy value of 1 mg KOH/g or less. Table 1 illustrates the physical properties of the compound evaluated as lubricant base oil for power transmission (F).

Example 7

The procedure of Example 1 was repeated except that 2-methyl-1,3-propanediol was changed to 240.4 g (1.5 mol) of 2,4-diethyl-1,5-pentanediol, thereby obtaining 521.0 g (1.28 mol) of 2,4-diethyl-1,5-pentanediol bis(3-methylcyclohexanecarboxylate). The obtained compound had an acid value of 0.01 mg KOH/g or less and a hydroxy value of 1 mg KOH/g or less. Table 1 illustrates the physical properties of the compound evaluated as lubricant base oil for power transmission (G).

Example 8

The procedure of Example 1 was repeated except that 3-methylcyclohexanecarboxylic acid was changed to 515.5 g (3.3 mol) of 3,4-dimethylcyclohexanecarboxylic acid, and 2-methyl-1,3-propanediol was changed to 177.3 g (1.5 mol) of 3-methyl-1,5-pentanediol, thereby obtaining 532.7 g (1.35 mol) of 3-methyl-1,5-pentanediol bis(3,4-dimethylcyclohexanecarboxylate). The obtained compound had an acid value of 0.01 mg KOH/g or less and a hydroxy value of 1 mg KOH/g or less. Table 1 illustrates the physical properties of the compound evaluated as lubricant base oil for power transmission (H).

Example 9

The procedure of Example 1 was repeated except that 3-methylcyclohexanecarboxylic acid was changed to 515.5 g (3.3 mol) of 3,5-dimethylcyclohexanecarboxylic acid, and 2-methyl-1,3-propanediol was changed to 177.3 g (1.5 mol) of 3-methyl-1,5-pentanediol, thereby obtaining 538.6 g (1.37 mol) of 3-methyl-1,5-pentanediol bis(3,5-dimethylcyclohexanecarboxylate). The obtained compound had an acid value of 0.01 mg KOH/g or less and a hydroxy value of 1 mg KOH/g or less. Table 1 illustrates the physical properties of the compound evaluated as lubricant base oil for power transmission (I).

Example 10

The procedure of Example 1 was repeated except that 3-methylcyclohexanecarboxylic acid was changed to 608.1 g (3.3 mol) of 4-tert-butyl cyclohexanecarboxylic acid, and 2-methyl-1,3-propanediol was changed to 177.3 g (1.5 mol) of 3-methyl-1,5-pentanediol, thereby obtaining 554.4 g (1.23 mol) of 3-methyl-1,5-pentanediol bis(4-tert-butylcyclohexanecarboxylate). The obtained compound had an acid value of 0.01 mg KOH/g or less and a hydroxy value of 1 mg KOH/g or less. Table 1 illustrates the physical properties of the compound evaluated as lubricant base oil for power transmission (J).

Example 11

The procedure of Example 1 was repeated except that 3-methylcyclohexanecarboxylic acid was changed to 462.6 g (3.3 mol) of bicyclo[2.2.1]heptane carboxylic acid, and 2-methyl-1,3-propanediol was changed to 177.3 g (1.5 mol) of 3-methyl-1,5-pentanediol, thereby obtaining 467.7 g (1.29 mol) of 3-methyl-1,5-pentanediol bis(bicyclo[2.2.1]heptanecarboxylate). The obtained compound had an acid value of 0.01 mg KOH/g or less and a hydroxy value of 1 mg KOH/g or less. Table 1 illustrates the physical properties of the compound evaluated as lubricant base oil for power transmission (K).

Example 12

The procedure of Example 1 was repeated except that 3-methylcyclohexanecarboxylic acid was changed to 469.3 g (3.3 mol) of 2-methylcyclohexanecarboxylic acid, thereby obtaining 462.1 g (1.37 mol) of 2-methyl-1,3-propanediol bis(2-methylcyclohexanecarboxylate). The obtained compound had an acid value of 0.01 mg KOH/g or less and a hydroxy value of 1 mg KOH/g or less. Table 1 illustrates the physical properties of the compound evaluated as lubricant base oil for power transmission (L).

Example 13

The procedure of Example 1 was repeated except that 3-methylcyclohexanecarboxylic acid was changed to 469.6 g (3.3 mol) of 2-methylcyclohexanecarboxylic acid, and 2-methyl-1,3-propanediol was changed to 240.4 g (1.5 mol) of 2,4-diethyl-1,5-pentanediol, thereby obtaining 521.0 g (1.28 mol) of 2,4-diethyl-1,5-pentanediol di(2-methylcyclohexanecarboxylate). The obtained compound had an acid value of 0.01 mg KOH/g or less and a hydroxy value of 1 mg KOH/g or less. Table 1 illustrates the physical properties of the compound evaluated as lubricant base oil for power transmission (M).

Example 14

The procedure of Example 1 was repeated except that 3-methylcyclohexanecarboxylic acid was changed to 469.6 g (3.3 mol) of 4-methylcyclohexanecarboxylic acid, and 2-methyl-1,3-propanediol was changed to 240.4 g (1.5 mol) of 2,4-diethyl-1,5-pentanediol, thereby obtaining 514.9 g (1.26 mol) of 2,4-diethyl-1,5-pentanediol di(4-methylcyclohexanecarboxylate). The obtained compound had an acid value of 0.01 mg KOH/g or less and a hydroxy value of 1 mg KOH/g or less. Table 1 illustrates the physical properties of the compound evaluated as lubricant base oil for power transmission (N).

Comparative Example 1

The procedure of Example 1 was repeated except that 3-methylcyclohexanecarboxylic acid was changed to 423.0 g (3.3 mol) of cyclohexanecarboxylic acid, and 2-methyl-1,3-propanediol was changed to 135.2 g (1.5 mol) of 1,3-butanediol, thereby obtaining 366.3 g (1.18 mol) of 1,3-butanediol di(cyclohexanecarboxylate). The obtained compound had an acid value of 0.01 mg KOH/g or less and a hydroxy value of 1 mg KOH/g or less. Table 2 illustrates the physical properties of the compound evaluated as lubricant base oil for power transmission (a).

Comparative Example 2

The procedure of Example 1 was repeated except that 3-methylcyclohexanecarboxylic acid was changed to 423.0 g (3.3 mol) of cyclohexanecarboxylic acid, and 2-methyl-1,3-propanediol was changed to 156.2 g (1.5 mol) of 2,2-dimethyl-1,3-propanediol, thereby obtaining 395.8 g (1.22 mol) of 2,2-dimethyl-1,3-propanediol di(cyclohexanecarboxylate). The obtained compound had an acid value of 0.01 mg KOH/g or less and a hydroxy value of 1 mg KOH/g or less. Table 2 illustrates the physical properties of the compound evaluated as lubricant base oil for power transmission (b).

Comparative Example 3

The procedure of Example 1 was repeated except that 2-methyl-1,3-propanediol was changed to 135.2 g (1.5 mol) of 1,3-butanediol, thereby obtaining 457.0 g (1.35 mol) of 1,3-butanediol bis(3-methylcyclohexanecarboxylate). The obtained compound had an acid value of 0.01 mg KOH/g or less and a hydroxy value of 1 mg KOH/g or less. Table 2 illustrates the physical properties of the compound evaluated as lubricant base oil for power transmission (c).

Comparative Example 4

Table 2 illustrates the physical properties of diisodecyl adipate evaluated as lubricant base oil for power transmission (d).

Comparative Example 5

Table 2 illustrates the physical properties of mineral oil Y evaluated as lubricant base oil for power transmission (e).

TABLE 1

| | Example 1 | Example 2 | Example 3 | Example 4 | Example 5 | Example 6 | Example 7 |
|---|---|---|---|---|---|---|---|
| Lubricant Base Oil for Power Transmission | (A) | (B) | (C) | (D) | (E) | (F) | (G) |
| Traction Coefficient (60° C.) | 0.100 | 0.090 | 0.102 | 0.096 | 0.101 | 0.104 | 0.101 |
| Evaluation | A | B | A | B | A | A | A |
| Pour Point (° C.) | −45 | −37.5 | −40 | −50 | −42.5 | −32.5 | −40 |
| Evaluation | A | B | A | A | A | B | A |
| Flash Point (° C.) | 204 | 228 | 224 | 214 | 242 | 218 | 222 |
| Evaluation | B | A | A | B | A | B | A |

| | Example 8 | Example 9 | Example 10 | Example 11 | Example 12 | Example 13 | Example 14 |
|---|---|---|---|---|---|---|---|
| Lubricant Base Oil for Power Transmission | (H) | (I) | (J) | (K) | (L) | (M) | (N) |
| Traction Coefficient (60° C.) | 0.101 | 0.096 | 0.110 | 0.100 | 0.109 | 0.108 | 0.095 |
| Evaluation | A | B | A | A | A | A | B |
| Pour Point (° C.) | −42.5 | −42.5 | −30 | −37.5 | −32.5 | −30 | −35 |
| Evaluation | A | A | B | B | B | B | B |
| Flash Point (° C.) | 232 | 226 | 264 | 234 | 216 | 232 | 240 |
| Evaluation | A | A | A | A | B | A | A |

TABLE 2

| | Comparative Example 1 | Comparative Example 2 | Comparative Example 3 | Comparative Example 4 | Comparative Example 5 |
|---|---|---|---|---|---|
| Lubricant Base Oil for Power Transmission | (a) | (b) | (c) | (d) | (e) |

TABLE 2-continued

| | Comparative Example 1 | Comparative Example 2 | Comparative Example 3 | Comparative Example 4 | Comparative Example 5 |
|---|---|---|---|---|---|
| Traction Coefficient (60° C.) | 0.099 | 0.101 | 0.097 | 0.035 | 0.053 |
| Evaluation | B | A | B | C | C |
| Pour Point (° C.) | −40 | 30 | −42.5 | −62.5 | −35 |
| Evaluation | A | C | A | A | B |
| Flash Point (° C.) | 196 | 206 | 194 | 235 | 190 |
| Evaluation | C | B | C | A | C |

Table 1 indicates that the lubricant base oil for power transmission according to the present invention is an excellent lubricant base oil for power transmission that has a high traction coefficient, excellent low-temperature fluidity, and a high flash point.

INDUSTRIAL APPLICABILITY

Due to its high traction coefficient, high flash point, and excellent low-temperature fluidity, the lubricant base oil for power transmission according to the present invention can be suitably used in lubricant base oils for power transmission (in particular, lubricant base oils for traction drives), for example, for automobiles, marine vessels, aircraft, and precision equipment.

The invention claimed is:

1. A lubricant base oil for power transmission, the lubricant base oil comprising a compound represented by formula (1):

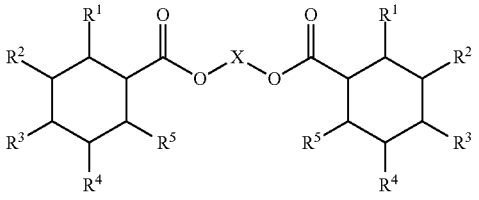

(1)

wherein $R^1$ to $R^5$ are the same or different, and each represents a hydrogen atom or a $C_{1-4}$ linear or branched alkyl group, any two of $R^1$ to $R^5$ may bind to each other to form a $C_{1-4}$ alkylene group, two $R^1$s, two $R^2$s, two $R^3$s, two $R^4$s, and two $R^5$s may be individually the same or different, and X is a divalent group obtained by removing two hydroxyl groups from one member selected from the group consisting of 2-methyl-1,3-propanediol, 3-methyl-1,5-pentanediol, and 2,4-diethyl-1,5-pentanediol.

2. The lubricant base oil for power transmission according to claim 1, wherein $R^1$ to $R^5$ in formula (1) are the same or different, and each represents a hydrogen atom, a methyl group, an ethyl group, an isopropyl group, or a tert-butyl group, and any two of $R^1$ to $R^5$ may bind to each other to form a methylene group or a butylene group.

3. The lubricant base oil for power transmission according to claim 1, wherein the content of the compound represented by formula (1) in the lubricant base oil for power transmission is 70 mass % or more.

4. The lubricant base oil for power transmission according to claim 1, wherein the lubricant base oil for power transmission is a lubricant base oil for traction drives.

5. A lubricant oil for power transmission comprising the lubricant base oil for power transmission of claim 1.

* * * * *